US011161122B2

(12) United States Patent
Kim et al.

(10) Patent No.: US 11,161,122 B2
(45) Date of Patent: Nov. 2, 2021

(54) ROLL FILM SHREDDING DEVICE

(71) Applicant: IDP CORPORATION LTD., Seoul (KR)

(72) Inventors: Changbum Kim, Incheon (KR); Junkyu Park, Seoul (KR)

(73) Assignee: IDP CORPORATION LTD., Seoul (KR)

( * ) Notice: Subject to any disclaimer, the term of this patent is extended or adjusted under 35 U.S.C. 154(b) by 164 days.

(21) Appl. No.: 16/613,830

(22) PCT Filed: Feb. 8, 2018

(86) PCT No.: PCT/KR2018/001696
§ 371 (c)(1),
(2) Date: Nov. 15, 2019

(87) PCT Pub. No.: WO2018/212431
PCT Pub. Date: Nov. 22, 2018

(65) Prior Publication Data

US 2020/0179937 A1 Jun. 11, 2020

(30) Foreign Application Priority Data

May 17, 2017 (KR) ..... 10-2017-0061132

(51) Int. Cl.
*B02C 18/22* (2006.01)
*B02C 18/00* (2006.01)
(Continued)

(52) U.S. Cl.
CPC ..... *B02C 18/2225* (2013.01); *B02C 18/0007* (2013.01); *B02C 18/086* (2013.01)

(58) Field of Classification Search
CPC ..... B02C 18/2225; B02C 18/086; B02C 18/2208; B02C 18/06; B02C 18/007; B02C 19/0056; B02C 4/286; B02C 4/42
See application file for complete search history.

(56) References Cited

U.S. PATENT DOCUMENTS 4,028,779 A * 6/1977 Shah ..... B29B 17/04 241/73
4,294,414 A * 10/1981 Gerstenberg ..... B02C 18/148 241/222

(Continued)

FOREIGN PATENT DOCUMENTS

DE 2723281 A1 * 12/1978 ..... B02C 18/148
JP 2006-007034 A 1/2006

(Continued)

OTHER PUBLICATIONS

English translate (KR100782683B1), retrieved date Jun. 7, 2021.*
English translate (DE2723281A1), retrieved date Jun. 8, 2021.*

*Primary Examiner* — Faye Francis
*Assistant Examiner* — Mohammed S. Alawadi
(74) *Attorney, Agent, or Firm* — Novick, Kim & Lee, PLLC; Jae Youn Kim; Jihun Kim

(57) ABSTRACT

The present invention relates to a roll film shredding device, and more specifically to a roll film shredding device which rapidly and effectively shreds a long object rolled up into a roll shape, and in particular twists and crumples an object and then performs a shredding operation, thereby effectively shredding an object even though the object is thin, flexible and viscid. The roll film shredding device according to the present invention includes a support frame; an object-to-be-shredded introducing member coupled to the support frame; an object-to-be-shredded twisting unit rotatably installed to the object-to-be-shredded introducing member and performing a twisting operation for an object to be shredded; a rotary driver driving the object-to-be-shredded twisting unit to rotate and perform the twisting operation; and a cutter cutting the object twisted by the object-to-be-shredded twisting unit.

8 Claims, 9 Drawing Sheets

(51) Int. Cl.

| | |
|---|---|
| ***B02C 18/08*** | (2006.01) |
| ***B02C 19/00*** | (2006.01) |
| ***B02C 4/28*** | (2006.01) |
| ***B02C 4/42*** | (2006.01) |
| ***B02C 18/06*** | (2006.01) |

(56) References Cited

U.S. PATENT DOCUMENTS

| | | | | |
|---|---|---|---|---|
| 5,217,172 | A * | 6/1993 | Phillips | B02C 18/148 241/101.2 |
| 6,685,116 | B1 | 2/2004 | Hisazumi et al. | |
| 2003/0116664 | A1* | 6/2003 | Castronovo | B02C 18/16 241/185.5 |
| 2004/0251340 | A1* | 12/2004 | Tavares | A61L 27/16 241/34 |
| 2013/0146687 | A1* | 6/2013 | Foss | B29B 9/04 241/19 |
| 2014/0197255 | A1* | 7/2014 | Reif | B02C 18/18 241/27 |
| 2016/0067713 | A1* | 3/2016 | Okamoto | G01F 23/20 241/225 |

FOREIGN PATENT DOCUMENTS

| | | | |
|---|---|---|---|
| JP | 2010-149108 | A | 7/2010 |
| KR | 10-2003-0034539 | A | 5/2003 |
| KR | 100782683 | B1 * | 12/2007 |
| KR | 20-0448473 | Y1 | 4/2010 |
| KR | 10-1187020 | B1 | 9/2012 |

* cited by examiner

ROLL FILM SHREDDING DEVICE

TECHNICAL FIELD

The present invention relates to a roll film shredding device, and more specifically to a roll film shredding device which rapidly and effectively shreds a long object rolled up into a roll shape, and in particular twists and crumples an object and then performs a shredding operation, thereby effectively shredding an object even though the object is thin, flexible and viscid.

BACKGROUND ART

In general, a card printer refers to a device for printing processed data received from a computer on a surface of a certificate of resident registration, an identification card, an employee card, or the like various cards.

As shown in FIG. 1, a card a is supplied from a card supplier (not shown), the card printer performs a printing job by driving a thermal printing head 10 in a state that a printing ribbon 40 is positioned on a printing surface of the card a.

The printing ribbon 40 rolled up on a feeding roll 30 is unrolled by a printing ribbon driver (not shown), guided and moved by a guide roller 60, and rolled up again on the winding roll 50 after carrying out a printing process.

Further, when the printing ribbon 40 rolled up on the feeding roll 30 is completely unrolled and then rolled up on the winding roll 50 as the printing process is carried out, the whole printing ribbon unit including the feeding roll 30, the printing ribbon 40, and the winding roll 50 is removed and discarded.

However, the printing ribbon 40 has shortcomings that printing information leaks to the outside because thermal transfer printing causes a printed image, character, design, and the like printing information to remain in the form of an intaglio pattern. In particular, a card used in a bank, a securities company, and the like financial institutions may be cloned as personal information leaks to the outside, thereby causing serious financial damage.

To solve such a problem, a method has recently been proposed to shred a waste printing ribbon unit. However, the printing ribbon has not only a structure of a film sheet that is very thin and flexible but also viscosity or the like of a print ink layer applied to a film sheet, and therefore it has been disadvantageously difficult and hard for a general shredding device to shred the printing ribbon. Further, a conventional shredding device has limits to practical use because its shredding speed is low and it takes too much time to shred a relatively long object such as a printing ribbon. Accordingly, a shredding device capable of effectively shredding a printing ribbon or the like object-shaped like a film sheet has been urgently required.

DISCLOSURE

Technical Problem

Accordingly, the present invention is proposed based on the foregoing content, and an aspect of the present invention is to provide a roll film shredding device which rapidly and effectively shreds a long object rolled up into a roll shape.

Another aspect of the present invention is to provide a roll film shredding device which twists and crumples an object and then performs a shredding operation, thereby effectively shredding an object even though the object is thin, flexible and viscid.

Technical Solution

According to an aspect of the disclosure, there is provided a roll film shredding device including: a support frame; an object-to-be-shredded introducing member coupled to the support frame; an object-to-be-shredded twisting unit rotatably installed to the object-to-be-shredded introducing member and performing a twisting operation for an object to be shredded; a rotary driver driving the object-to-be-shredded twisting unit to rotate and perform the twisting operation; and a cutter cutting the object twisted by the object-to-be-shredded twisting unit.

The object-to-be-shredded introducing member may have a structure that a central gear is formed in an introducing shaft including an introducing hole, and the object-to-be-shredded twisting unit may include a rotary base rotatably installed in the object-to-be-shredded introducing member, a power transmission unit for transmission of rotary power, and a first feeding roller and a second feeding roller installed to form a pair and face each other in the rotary base and rotated by the rotary power transmitted from the power transmission unit.

The cutter may include a rotary cutter placed under the first feeding roller and second feeding roller and formed with a blade on an outer circumferential surface thereof, and a cutter idle roller disposed facing the rotary cutter.

Preferably, the power transmission unit may include a first electromotive gear engaging with the central gear, a worm coupled to the center of the first electromotive gear, a worm wheel engaging with the worm and coupling with the first feeding roller at one end of a central shaft thereof, a second electromotive gear connected to the other end of the central shaft of the worm wheel, a third electromotive gear engaging with the second electromotive gear and coupling with the second feeding roller at a central shaft thereof, a fourth electromotive gear formed as a single body with the third electromotive gear, and a fifth electromotive gear engaging with the fourth electromotive gear and coupling with the rotary cutter at a central shaft thereof.

Further, the first feeding roller and the second feeding roller may include introducing grooves recessed on outer circumferential surfaces of roller bodies shaped like discs and introducing the object to be shredded.

Meanwhile, the rotary base may include a first housing plate and a second housing plate placing the first feeding roller and the second feeding roller and the cutter inside and formed with outlets in a lower portion thereof, and a rotary plate coupled to upper portions of the first housing plate and second housing plate and having a center portion rotatably coupled to the object-to-be-shredded introducing member with a rotary guide member therebetween.

The rotary driver may include a driving motor, a belt having one side connected to a driving pully coupled to a rotary shaft of the driving motor, and an electromotive pully coupled to the rotary plate and connected to the other side of the belt.

The roll film shredding device according to the present invention may include an outlet bearing installed in the outlets of the first housing plate and the second housing plate; a base plate formed with a connection hole to which the outlet bearing is connected; and a bin connected to the base plate.

Further, the roll film shredding device may further include: an object-to-be-shredded holder to hold an object to be shredded; and an object-to-be-shredded guider installed in the support frame and introducing and guiding movement of the object drawn out from the object-to-be-shredded holder.

Here, the object-to-be-shredded holder may include a holding bracket formed with a moving hole, a guide member coupled to the holding bracket, a moving shaft movably inserted in the guide member, a compression spring inserted in the moving shaft, a holding cone coupled to an inner end portion of the moving shaft, and a stopping member coupled to an outer end portion of the moving shaft.

Advantageous Effects

As described above, a roll film shredding device according to the disclosure has an effect on rapidly and effectively shredding a long object, which is rolled up into a roll shape, by a rotary cutter with a plurality of blades. In particular, a roll film shredding device according to the disclosure compresses an object to be small and hard by twisting and crumpling operations of an object-to-be-shredded twisting unit, thereby having an effect on rapidly and effectively shredding the thin, flexible and viscid object such as a printing ribbon.

DESCRIPTION OF DRAWINGS

FIGS. 5*a* to 5*c* are views for explaining a major part of the roll film shredding device according to the first embodiment of the present invention, in which FIG. 5*a* is a partial perspective view from the front, FIG. 5*b* is a perspective view from the back, and FIG. 5*c* is an exploded perspective view.

BEST MODE

Below, preferred embodiments of the present invention will be described in detail with reference to the accompanying drawings of FIGS. 2 to 6*b*, and like numerals refer to like elements throughout FIGS. 2 to 6*b*. Meanwhile, with the drawings, illustrations and detailed descriptions about elements (e.g. a bolt, a nut, a shaft, a bearing, etc.) generally known to those skilled in the art and their operations and effects will be brief or omitted, and illustrations will be made focusing on parts related to the present invention.

Figure 1:
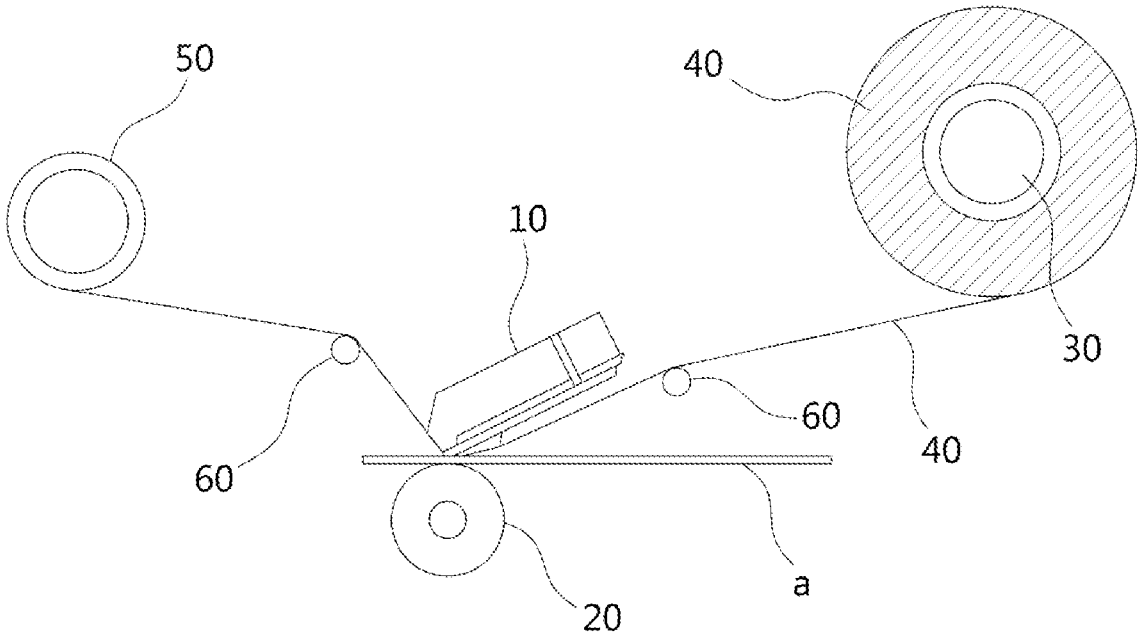
FIG. 1 Prior Art
FIG. 1 is a view for explaining a printing ribbon in a general card printer and its operating mechanism.
Figure 2:
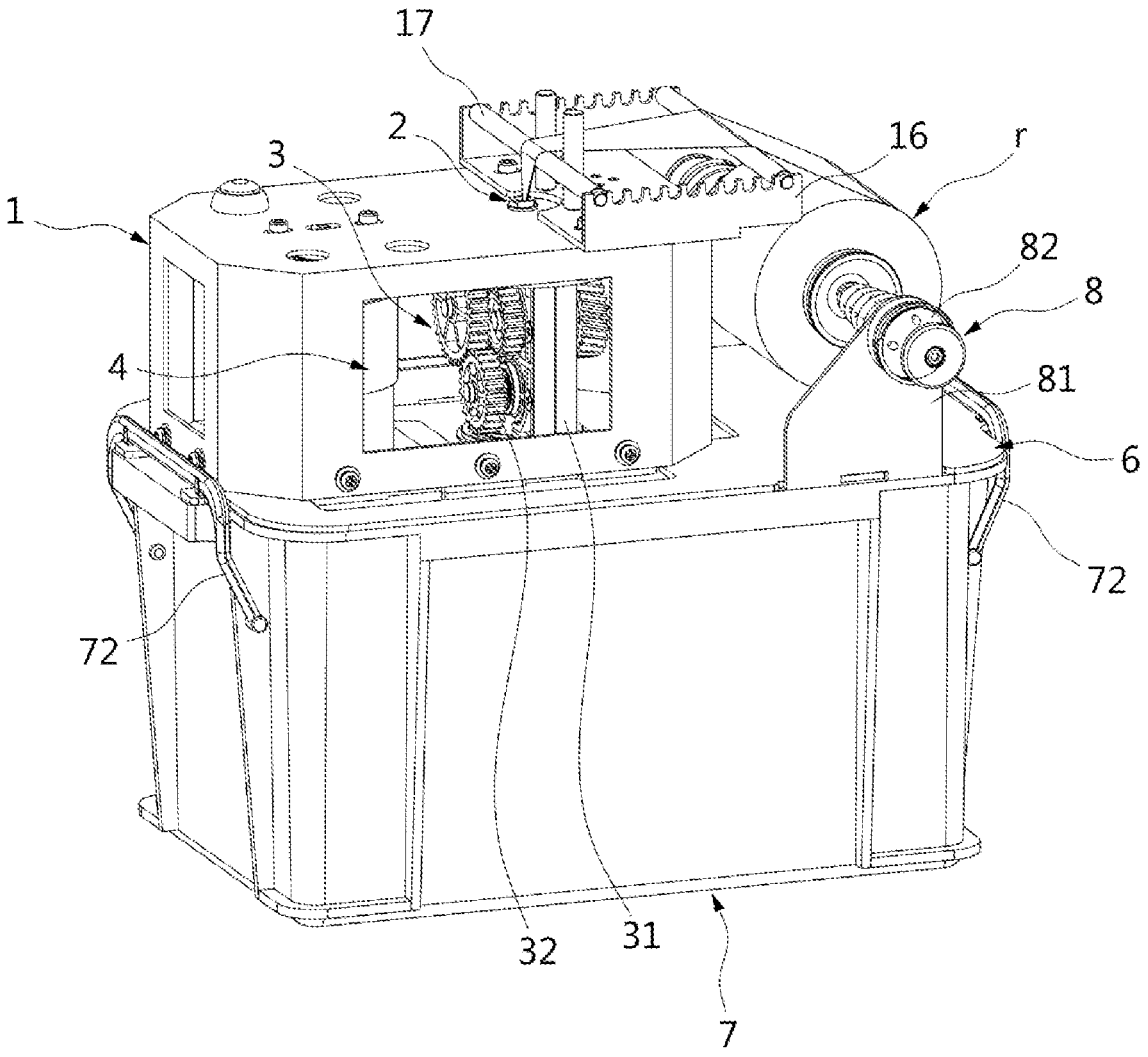
FIG. 2 is a perspective view of an overall outer appearance of a roll film shredding device according to a first embodiment of the present invention.
Figure 3:
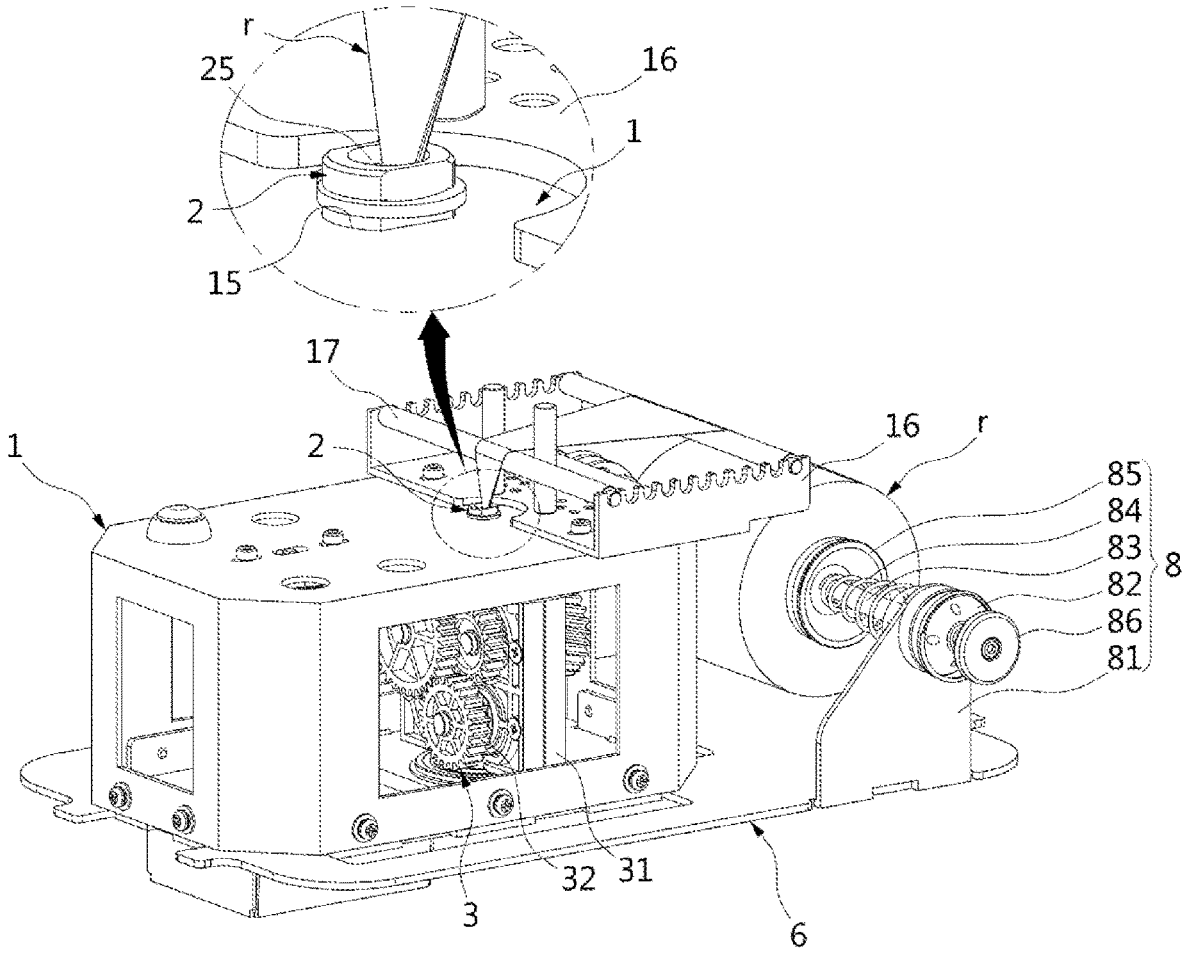
FIG. 3 is a perspective view of a major outer appearance of the roll film shredding device according to the first embodiment of the present invention.
Figure 4:
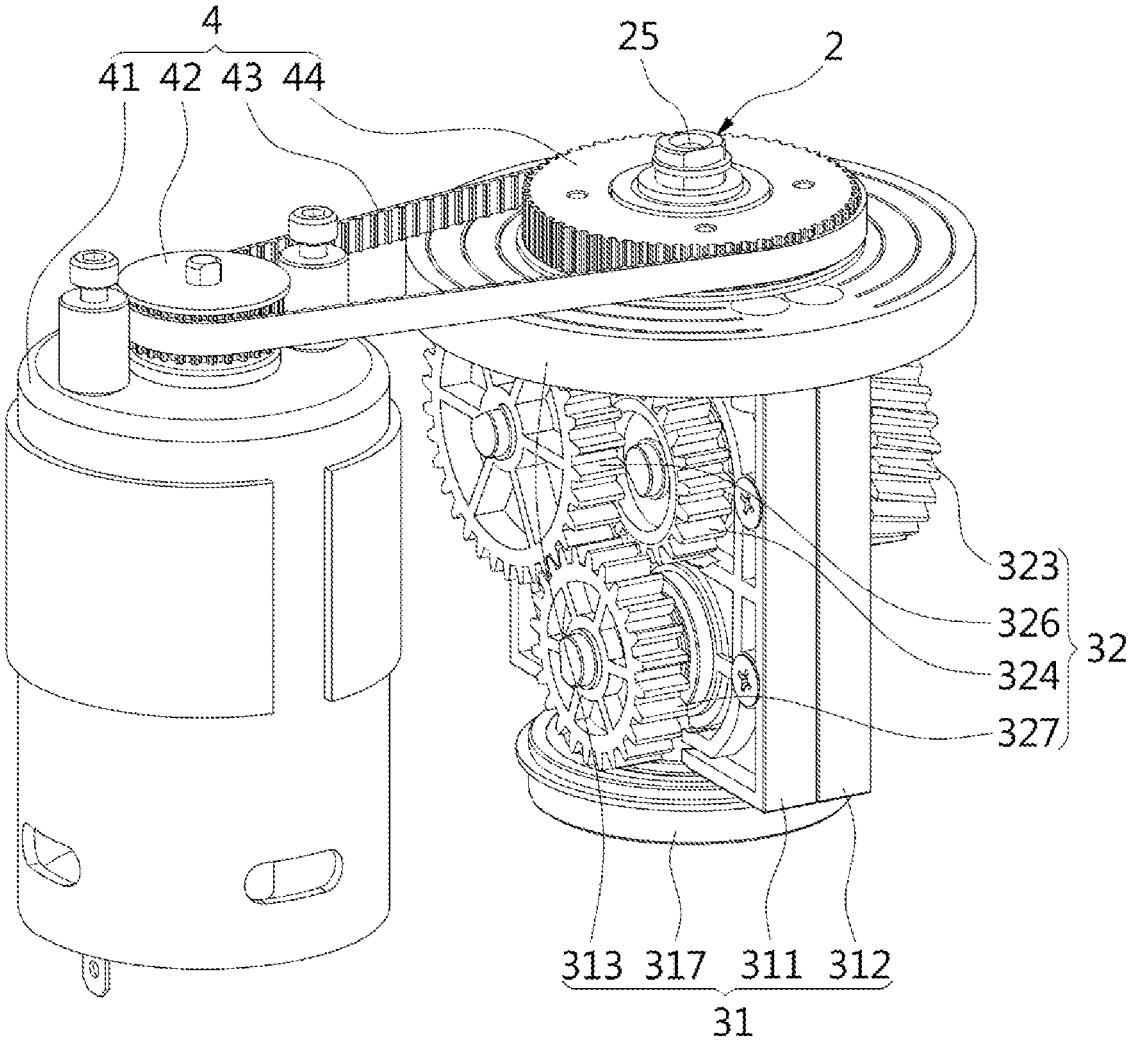
FIG. 4 is a perspective view showing an interior structure of the roll film shredding device according to the first embodiment of the present invention.
Figure 5A:
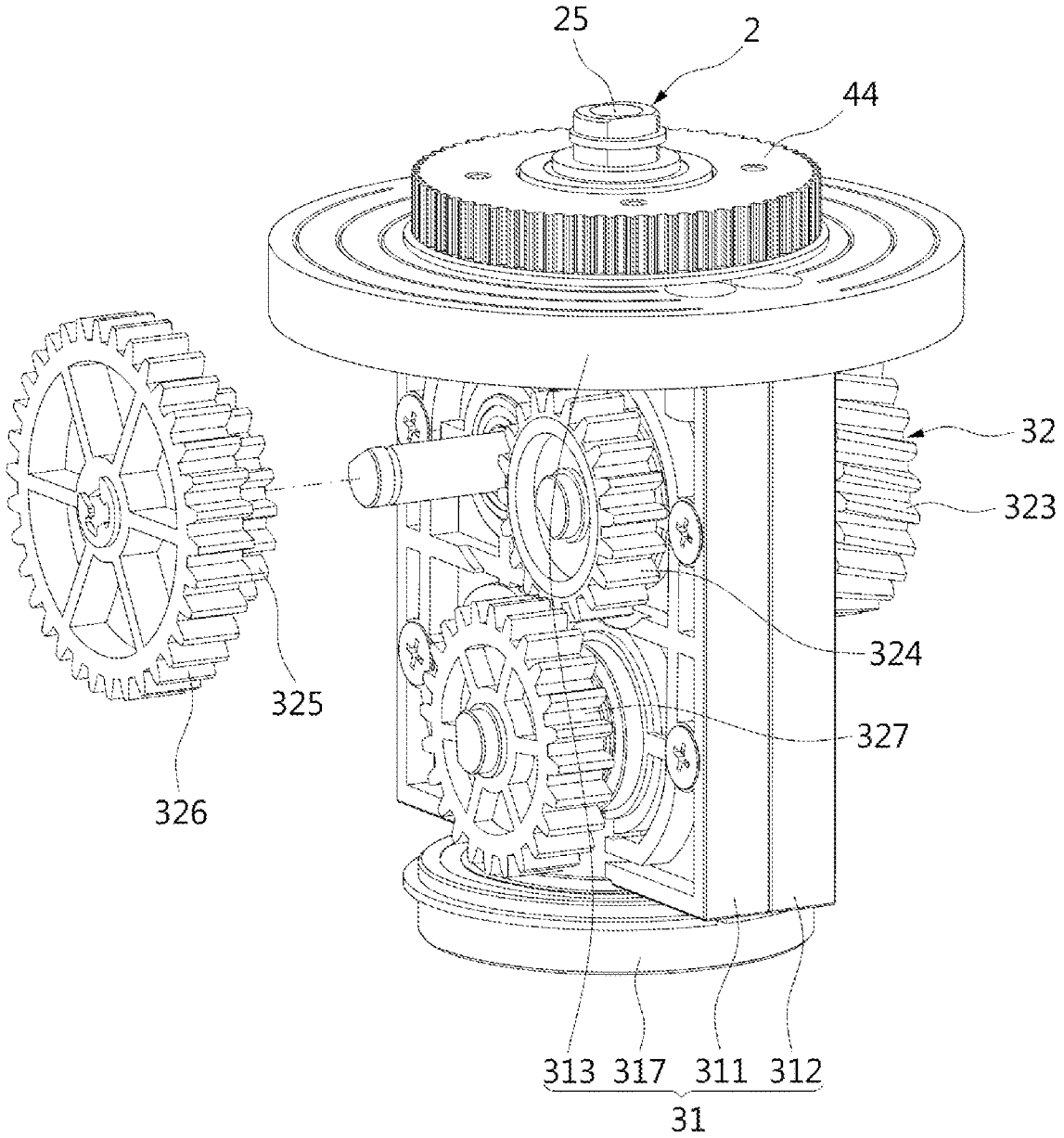
Figure 5B:
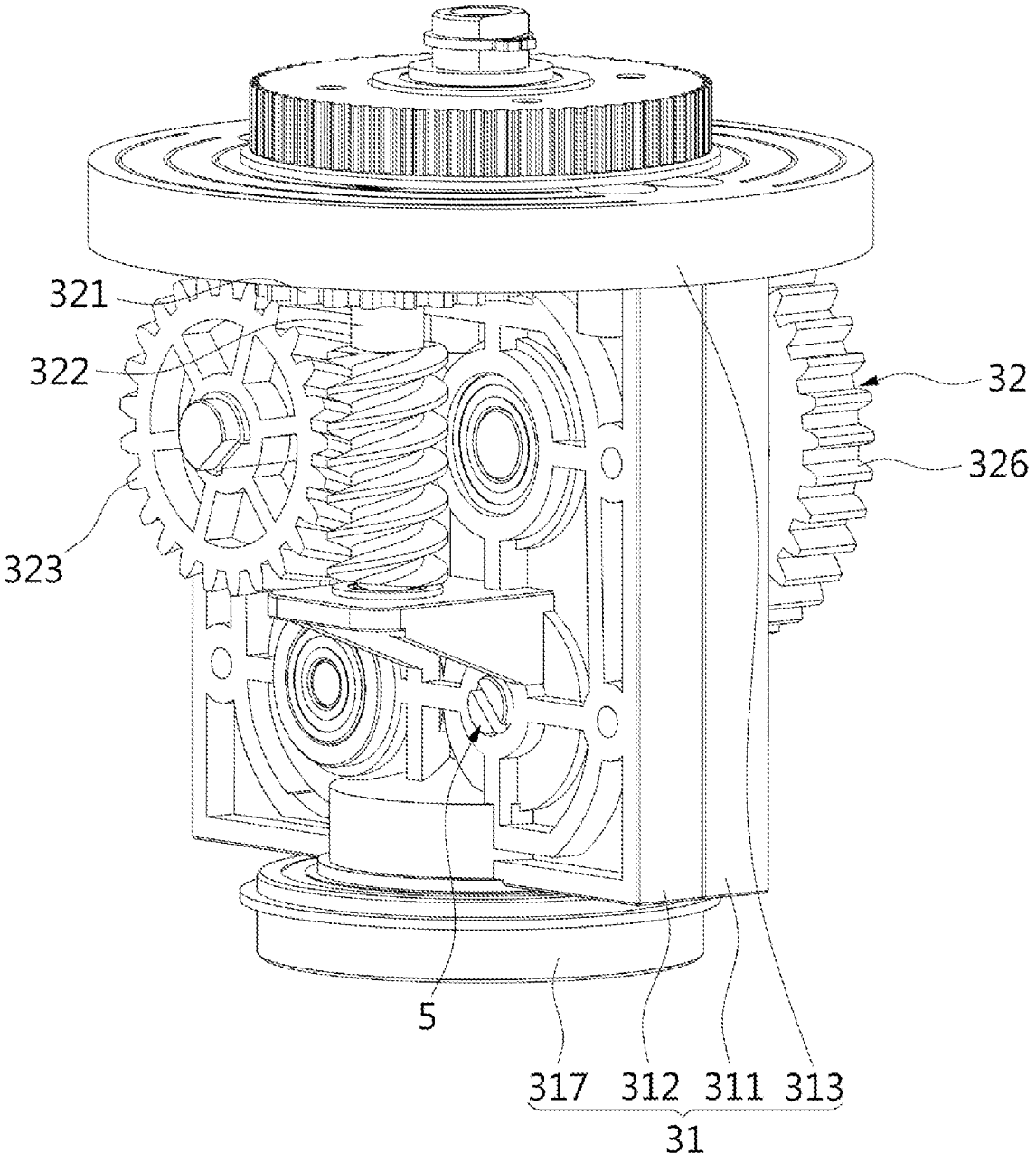
Figure 5C:
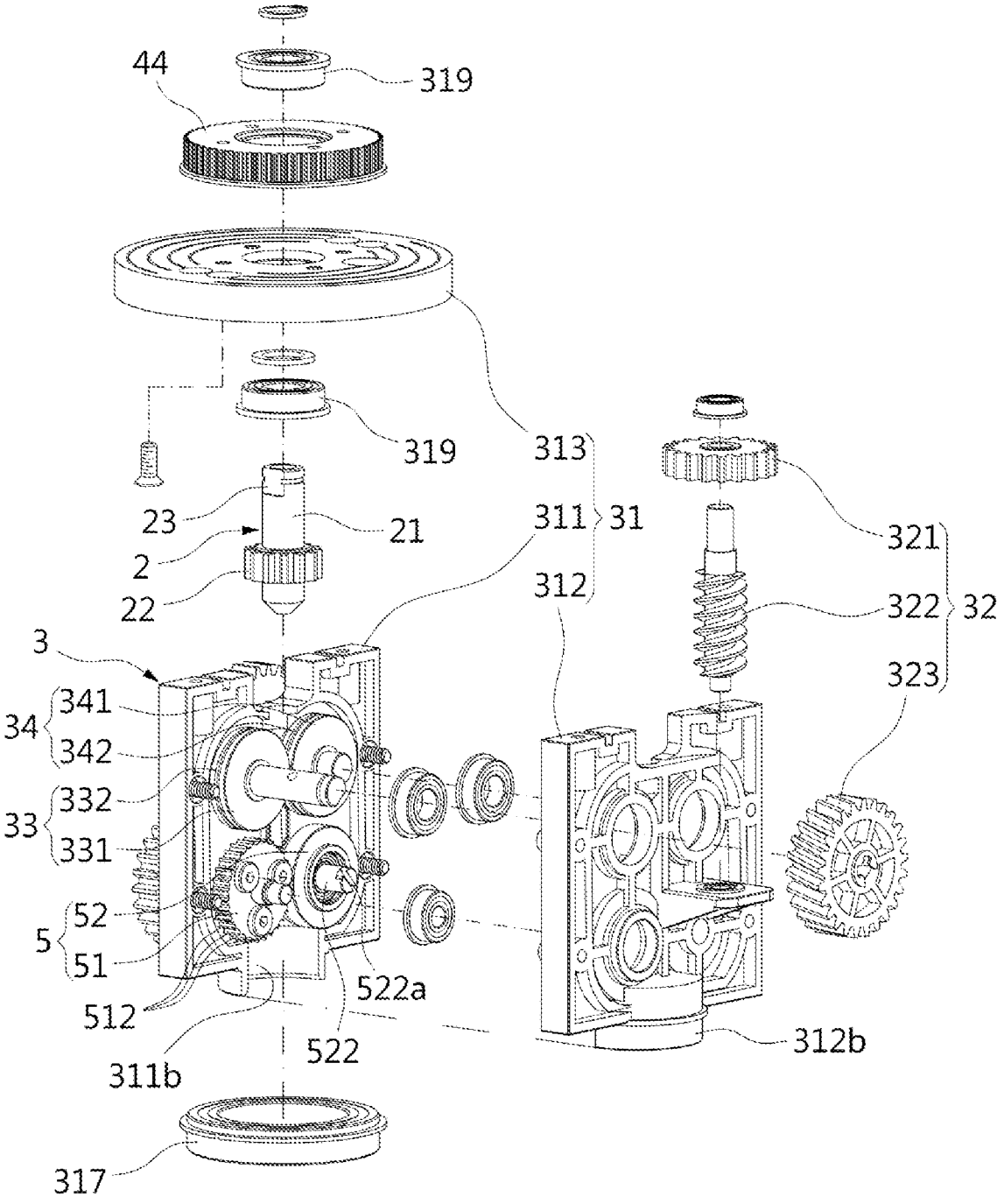

FIG. 2 is a perspective view of an overall outer appearance of a roll film shredding device according to a first embodiment of the present invention, FIG. 3 is a perspective view of a major outer appearance of the roll film shredding device according to the first embodiment of the present invention, FIG. 4 is a perspective view showing an interior structure of the roll film shredding device according to the first embodiment of the present invention, and FIGS. 5*a* to 5*c* are views for explaining a major part of the roll film shredding device according to the first embodiment of the present invention, in which FIG. 5*a* is a partial perspective view from the front, FIG. 5*b* is a perspective view from the back, and FIG. 5*c* is an exploded perspective view.

Referring to FIG. 2 to FIG. 5*c*, the roll film shredding device according to the first embodiment of the present invention is to shred a long object rolled up into a roll shape r (hereinafter, referred to as a 'roll film' or an 'object-to-be-shredded'), and includes a support frame 1, an object-to-be-shredded introducing member 2, an object-to-be-shredded twisting unit 3, a rotary driver 4, a cutter 5, a base frame 6, a bin 7, etc.

The support frame 1, to which an object-to-be-shredded introducing member 2 is coupled and fixed, as shown in FIG. 3, is approximately shaped like a hexahedron with a plurality of boards, but may have various shapes and structures without limitations.

The object-to-be-shredded introducing member 2 refers to an element through which an object to be shredded is introduced, and has a structure that a central gear 22 is formed in an introducing shaft 21 shaped like a round bar having an introducing hole 25. Further, the object-to-be-shredded introducing member 2 has an upper portion fixed to the support frame 1 so as not to rotate along with rotation of the object-to-be-shredded twisting unit 3, and opposite sides at an upper end of the introducing shaft 21 are formed with a cutting surface 23 typically called 'D' to be in surface-contact with and fixed to a fitting hole 15 formed in the support frame 1.

The object-to-be-shredded twisting unit 3 refers to an element that performs a twisting operation for an object to be shredded before a shredding operation so that the shredding operation can be stably carried out, and is rotatably installed being hung from the object-to-be-shredded introducing member 2.

The object-to-be-shredded twisting unit 3 includes a rotary base 31 rotatably installed in the object-to-be-shredded introducing member 2, a power transmission unit 32 for transmission of rotary power, and a first feeding roller 33 and a second feeding roller 34 which are installed to form a pair and face each other in the rotary base 31 and rotated by rotary power transmitted from the power transmission unit 32.

Concretely, detailed configuration of the object-to-be-shredded twisting unit 3 is as follows. The rotary base 31 includes a first housing plate 311 and a second housing plate 312 coupled facing each other with outlets 311*b* and 312*b* formed in a lower portion thereof and placing the first feeding roller 33 and the second feeding roller 34 and the cutter 5 therein, and a rotary plate 313 coupled to upper portions of the first housing plate 311 and the second housing plate 312 and having a center portion rotatably coupled to the object-to-be-shredded introducing member 2 with a bearing (or bushing) or the like rotary guide member 319 therebetween.

The power transmission unit 32 includes a first electromotive gear 321 engaging with the central gear 22 of the object-to-be-shredded introducing member 2, a worm 322 coupled to the center of the first electromotive gear 321, a worm wheel 323 engaging with the worm 322 and coupling with the first feeding roller 33 at one end of a central shaft thereof, a second electromotive gear 324 connected to the other end of the central shaft of the worm wheel 323, a third electromotive gear 325 engaging with the second electromotive gear 324 and coupling with the second feeding roller 34 at a central shaft thereof, a fourth electromotive gear 326 formed as a single body with the third electromotive gear 325, and a fifth electromotive gear 327 engaging with the fourth electromotive gear 326 and coupling with a rotary cutter 51 at a central shaft thereof.

The first feeding roller 33 and the second feeding roller 34 refer to elements which perform a function of pressing and compressing an object to be shredded, and have a structure that introducing grooves 332 and 342 for introducing the object to be shredded are recessed on outer circumferential surfaces of roller bodies 331 and 341 shaped like discs.

Meanwhile, the cutter 5 refers to an element for cutting an object-to-be-shredded r twisted by the object-to-be-shredded twisting unit 3, and may be spaced apart from and configured independently of the object-to-be-shredded twisting unit 3. In this embodiment, for more effective shredding, as shown in FIG. 5*c*, the cutter 5 includes the rotary cutter 51 placed under the first feeding roller 33 and the second feeding roller 34 and formed with a blade 512 on the outer circumferential surface thereof, and a cutter idle roller 52 disposed to face the rotary cutter 51.

Further, the cutter idle roller 52 is formed with an eccentric cam (not shown) provided at a roller shaft 522 coupled to a central hole thereof, and adjusting a gap from the rotary cutter 51. When such an eccentric cam provided in the roller shaft 522 is rotated by a screwdriver or the like tool inserted through a tool insertion groove 522*a*, the cutter idle roller 52 is eccentrically shifted corresponding to change in a radius based on the rotation of the eccentric cam and thus the gap between the cutter idle roller 52 and the blade 512 of the rotary cutter 51 becomes wider or narrower, thereby improving convenience in use with the gap adjusted according to the kinds of object to be shredded.

The rotary driver 4 refers to an element for rotating the whole object-to-be-shredded twisting unit 3 to twist the roll film r and giving shredding power to the cutter 5, and includes a driving motor 41, a driving pully 42 coupled to the rotary shaft of the driving motor 41, a belt 43 having one side connected to the driving pully 42, and an electromotive pully 44 coupled to the rotary plate 313 and connected to the other side of the belt 43. Here, the driving pully 42 and the electromotive pully 44 are provided as timing pullies, and the belt 43 is provided as a timing belt.

Meanwhile, the roll film shredding device according to the first embodiment of the present invention includes an outlet bearing 317 installed in the outlets 311*b* and 312*b* of the first housing plate 311 and second housing plate 312, and a base plate 6 formed with a connection hole (not shown) to which the outlet bearing 317 is connected.

Further, the base plate 6 is provided with the bin 7 in which the object r shredded by the rotary cutter 51 is put. The bin 7 is shaped like a quadrangular box having an accommodating space inside, and detachably coupled to the base plate 6 by a fastening member 72.

Meanwhile, the roll film shredding device according to the first embodiment of the present invention includes an object-to-be-shredded holder 8 for holding an object to be shredded, and an object-to-be-shredded guider 16 installed in the support frame 1 and introducing and guiding movement of the object drawn out from the object-to-be-shredded holder 8.

The object-to-be-shredded holder 8 includes a holding bracket 81 formed with a moving hole, a guide member 82 coupled to the holding bracket 81, a moving shaft 83 movably inserted in the guide member 82, a compression spring 84 inserted in the moving shaft 83, a holding cone 85 coupled to an inner end portion of the moving shaft 83, and a stopping member 86 coupled to an outer end portion of the moving shaft 83.

The object-to-be-shredded guider 16 is formed to have a structure that guide shafts 17 for guiding movement of the roll film r such as a printing ribbon are coupled to front and back end portions of a plate approximately having a '['-shape, but may have various shapes and structures without limitations.

Below, the operation of the roll film shredding device according to the first embodiment of the present invention will be described in brief.

Figure 6A:
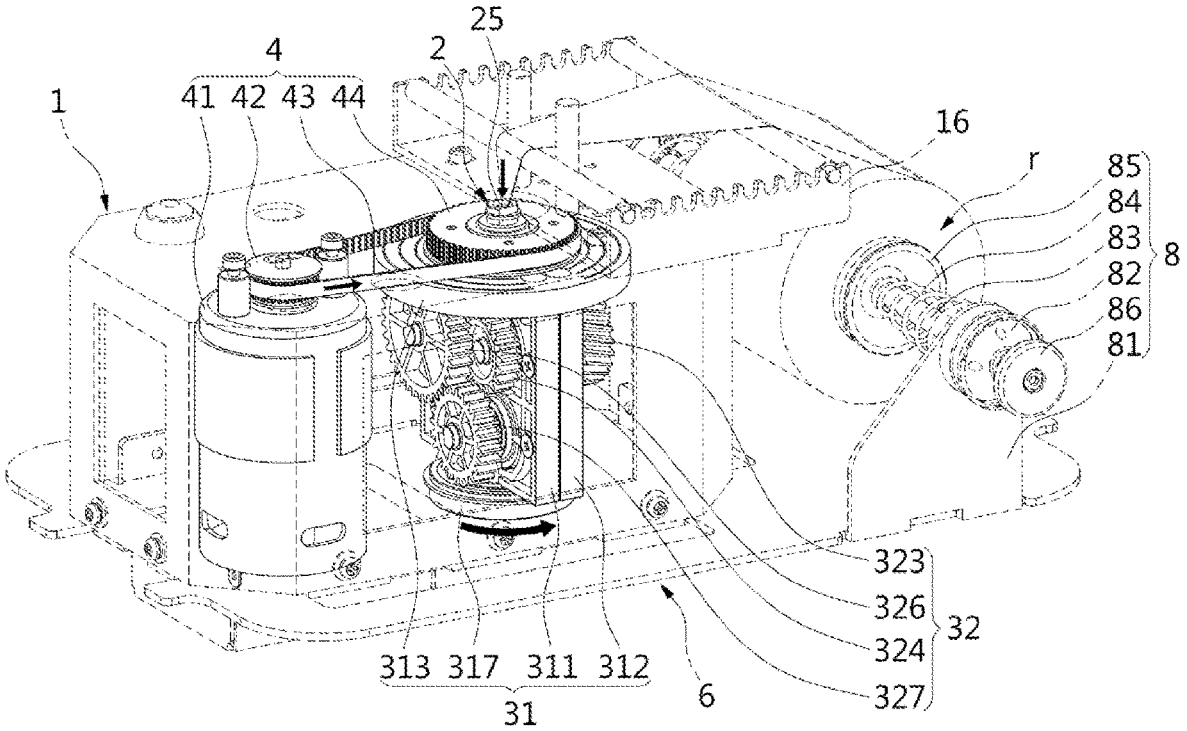
FIGS. 6*a* and 6*b* are views for explaining effects of the roll film shredding device according to the first embodiment of the present invention.
Figure 6B:
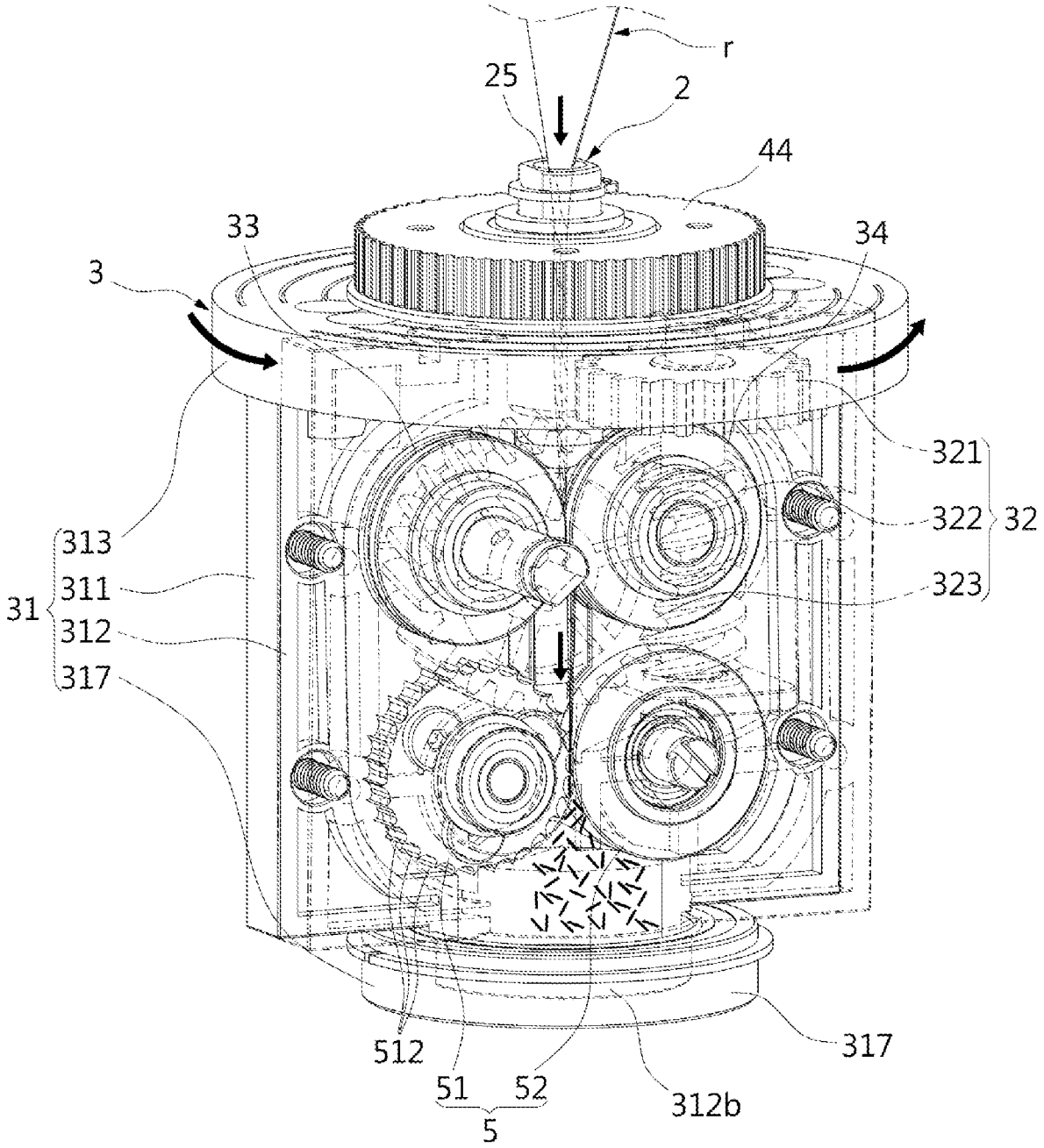

FIGS. 6*a* and 6*b* are views for explaining effects of the roll film shredding device according to the first embodiment of the present invention.

First, as shown in FIG. 6*a*, a used-up printing ribbon or the like roll film is separated from the card printer, and a winding roll r (or an object to be shredded) rolled up into a roll shape is inserted and held between the holding cones 85 of the object-to-be-shredded holder 8.

In this state, one end of the roll film is drawn out and inserted in the introducing hole 25 of the object-to-be-shredded introducing member 2, and power is on to make the driving motor 41 carry out a rotating operation and drive the electromotive pully 44 rotate by the medium of the driving pully 42 and the belt 43.

When the electromotive pully 44 rotates, its rotary power is transferred to the rotary plate 313 coupled to the electromotive pully 44, thereby rotating the first housing plate 311 and the second housing plate 312 coupled to the rotary plate 313. Like this, when the first housing plate 311 and the second housing plate 312 are rotated, the whole object-to-be-shredded twisting unit 3 including the power transmission unit 32 and the first feeding roller 33 and the second feeding roller 34 are rotated. At this time, the object-to-be-shredded introducing member 2 does not rotate but keeps stationary because its cutting surface 23 formed at the upper end is fitted to the fitting hole 15 formed in the support frame 1. In this case, the roll film introduced into the introducing hole 25 of the object-to-be-shredded introducing member 2 is naturally twisted to minimize the volume.

Further, when the first housing plate 311 and the second housing plates 312 are rotated, the first electromotive gear 321 coupled thereto is also rotated. Therefore, the first electromotive gear 321 is rotated engaging with the central gear 22 of the object-to-be-shredded introducing member 2 and thus carries out a rotary motion like an epicyclic motion Like this, when the first electromotive gear 321 rotates, the worm 322 coupled to the center of the first electromotive gear 321 is rotated, the worm wheel 323 engaging with the worm 322 is rotated, the second electromotive gear 324 connected to the other end of the central shaft of the worm wheel 323 is rotated, the fourth electromotive gear 326 formed as the single body with the third electromotive gear 325 is rotated as the third electromotive gear 325 engaging with the second electromotive gear 324 is rotated, and the fifth electromotive gear 327 engaging with the fourth electromotive gear 326 is rotated.

Further, when the worm wheel 323 rotates, the first feeding roller 33 coupled to one end of the central shaft of the worm wheel 323 and the second feeding roller 34 coupled to the central shaft of the third electromotive gear 326 are rotated, so that the roll film introduced into the introducing hole 25 of the object-to-be-shredded introducing member 2 can be compressed by pressure while passing between the introducing grooves 332 and 342 of the first feeding roller 33 and the second feeding roller 34 arranged to face each other as shown in FIG. 6*b*.

The roll film discharged from below the introducing grooves 332 and 342 of the first feeding roller 33 and the second feeding roller 34 is shredded into small pieces by a cutting operation of the blades 512 densely arranged and formed on the outer circumferential surface of the rotary cutter 51 while passing between the rotary cutter 51 and the cutter idle roller 52 as shown in FIG. 6*b*, and then fallen into and collected in the bin 7 through the outlets 311*b* and 312*b*. At this time, the outlet bearing 317 coupled to the outlets 311*b* and 312*b* of the first housing plate 311 and the second housing plate 312 is fastened to and rotatably supported by the base plate 6, and therefore the object-to-be-shredded twisting unit 3 smoothly carries out a rotary motion without interference.

In particularly, the roll film shredding device according to the present invention has advantages of high stability and efficiency in the shredding operation over even a printing ribbon or the like thin, flexible or viscous, and long object, which is hard to be shredded, because the roll film is primarily twisted and crumpled to decrease the volume by the rotary motion of the whole object-to-be-shredded twisting unit 3, secondarily compressed to become solid while passing between the first feeding roller 33 and the second feeding roller 34, and shredded by the rotary cutter 51.

The foregoing descriptions merely an embodiment for carrying out the roll film shredding device according to the present invention, and the present invention is not limited to the foregoing embodiment. It will be appreciated by a person having an ordinary skill in the art that various changes can be made in the technical concept of the present invention without departing from the scope defined in the following appended claims.

Terms used in the foregoing embodiment are only used to describe a specific embodiment, but not intended to limit the present invention. The singular forms are intended to include the plural forms as well, unless the context clearly indicates otherwise. It will be further understood that the terms "include" or "have", when used herein, specify the presence of stated features, integers, steps, operations, elements, components or combination thereof, but do not preclude the presence or addition of one or more other features, integers, steps, operations, elements, components, or combination thereof.

The invention claimed is:

1. A roll film shredding device comprising:

a support frame;

an object-to-be-shredded introducing member coupled to the support frame;

an object-to-be-shredded twisting unit rotatably coupled to the object-to-be-shredded introducing member to perform a twisting operation for an object to be shredded;

a rotary driver configured for driving the object-to-be-shredded twisting unit to rotate and perform the twisting operation; and a cutter configured for cutting the object twisted by the object-to-be-shredded twisting unit, wherein the object-to-be-shredded introducing member includes a central gear formed on an introducing shaft having an introducing hole, wherein the object-to-be-shredded twisting unit includes a rotary base rotatably coupled to the object-to-be-shredded introducing member, a power transmission gear assembly configured for transmitting rotary power, and a first feeding roller and a second feeding roller disposed in the rotary base and facing each other to be rotated by the rotary power transmitted from the power transmission gear assembly, and wherein the rotary base includes a first housing plate and a second housing plate connected to the first housing plate to place the first feeding roller, the second feeding roller, and the cutter inside thereof and having outlets at lower portions thereof, and a rotary plate coupled to upper portions of the first housing plate and the second housing plate and having a center portion rotatably coupled to the object-to-be-shredded introducing member with a rotary guide being placed therebetween.

2. The roll film shredding device according to claim 1, wherein the cutter comprises a rotary cutter placed under the first feeding roller and the second feeding roller and having a blade on an outer circumferential surface thereof, and a cutter idle roller disposed facing the rotary cutter.

3. The roll film shredding device according to claim 2, wherein the power transmission gear assembly comprises a first electromotive gear engaging with the central gear, a worm coupled to a center of the first electromotive gear, a worm wheel engaging with the worm and coupling with the first feeding roller at one end of a central shaft thereof, a second electromotive gear connected to another end of the central shaft of the worm wheel, a third electromotive gear engaging with the second electromotive gear and coupling with the second feeding roller at a central shaft thereof, a fourth electromotive gear formed as a single body with the third electromotive gear, and a fifth electromotive gear engaging with the fourth electromotive gear and coupling with the rotary cutter at a central shaft thereof.

4. The roll film shredding device according to claim 1, wherein the first feeding roller and the second feeding roller comprise introducing grooves recessed on outer circumferential surfaces of roller bodies thereof for introducing the object to be shredded.

5. The roll film shredding device according to claim 1, wherein the rotary driver comprises a driving motor, a belt having one side connected to a driving pully coupled to a rotary shaft of the driving motor, and an electromotive pully coupled to the rotary plate and connected to another side of the belt.

6. The roll film shredding device according to claim 5, further comprising:

an outlet bearing disposed in the outlets of the first housing plate and the second housing plate;

a base plate having a connection hole to which the outlet bearing is connected; and a bin connected to the base plate.

7. The roll film shredding device according to claim 1, further comprising:

an object-to-be-shredded holder configured to hold the object to be shredded; and an object-to-be-shredded guider disposed in the support frame for guiding movement of the object to be drawn out from the object-to-be-shredded holder.

8. The roll film shredding device according to claim 7, wherein the object-to-be-shredded holder comprises a holding bracket having a moving hole, a guide coupled to the holding bracket, a moving shaft movably coupled to the guide, a compression spring coupled to the moving shaft, a holding cone coupled to an inner end portion of the moving shaft, and a stopper coupled to an outer end portion of the moving shaft.

* * * * *